US010953898B1

(12) United States Patent
Zhang et al.

(10) Patent No.: US 10,953,898 B1
(45) Date of Patent: Mar. 23, 2021

(54) ACTIVE CONTROL SYSTEM FOR ROLLING BEHAVIORS OF HIGH-SPEED TRAINS

(71) Applicant: QINGDAO UNIVERSITY OF TECHNOLOGY, Shandong (CN)

(72) Inventors: Chunwei Zhang, Shandong (CN); Hao Wang, Shandong (CN); Yang Xu, Shandong (CN)

(73) Assignee: QINGDAO UNIVERSITY OF TECHNOLOGY, Qingdao (CN)

( * ) Notice: Subject to any disclaimer, the term of this patent is extended or adjusted under 35 U.S.C. 154(b) by 0 days.

(21) Appl. No.: 17/077,575

(22) Filed: Oct. 22, 2020

(30) Foreign Application Priority Data

Oct. 31, 2019 (CN) ..... 201911052304.1

(51) Int. Cl.
*B61L 3/00* (2006.01)
*B61L 15/00* (2006.01)

(52) U.S. Cl.
CPC ..... *B61L 3/006* (2013.01); *B61L 15/0054* (2013.01)

(58) Field of Classification Search
CPC ..... B61L 13/00; B61L 15/0054; B61F 5/02; B61F 5/245; B61F 5/22; B61F 5/06; B61F 5/08; B60G 17/00; B60G 17/016; B60G 17/0161; B60G 17/0162
See application file for complete search history.

(56) References Cited

U.S. PATENT DOCUMENTS 4,440,093 A * 4/1984 Kakehi ..... B60G 17/018 105/164
4,516,507 A * 5/1985 Dean, II ..... B61F 5/24 105/199.2
8,167,320 B2 * 5/2012 Chan ..... B62D 31/00 280/6.15
8,899,160 B2 * 12/2014 Haas ..... B61F 5/22 105/199.2
2003/0075071 A1 * 4/2003 Fleury ..... B61F 5/22 105/198.2

FOREIGN PATENT DOCUMENTS

CN 103196681 A 7/2013
CN 106184268 A 12/2016
CN 108099535 A 6/2018
CN 109094599 A 12/2018
KR 20100013481 A 2/2010

* cited by examiner

*Primary Examiner* — Robert J McCarry, Jr.

(57) ABSTRACT

An active control system for rolling behaviors of high-speed trains includes a sensor, a controller and an output device. The output device includes a power unit, an output unit and a casing. The power unit and the output unit are arranged inside the casing. The active control system applies active control torque to the shaking, rolling and nodding of the train body so as to control the train.

8 Claims, 4 Drawing Sheets

ACTIVE CONTROL SYSTEM FOR ROLLING BEHAVIORS OF HIGH-SPEED TRAINS

CROSS-REFERENCE TO RELATED APPLICATIONS

This application claims the benefit of priority from Chinese Patent Application No. 201911052304.1, filed on Oct. 31, 2019. The content of the aforementioned application, including any intervening amendments thereto, is incorporated herein by reference in its entirety.

TECHNICAL FIELD

The present application relates to vibration control, and more particularly to an active control system for rolling behaviors of high-speed trains.

BACKGROUND

High-speed trains have high running speed and complex dynamic behaviors. During the operation process, the trains may suffer from dynamic effects caused by track irregularities, air pressure differences generated when trains pass each other and other external factors such as wind, rain and snow. The dynamic behavior of the high-speed train generally involves a complex combination of translation (floating, yawing and stretching), swinging motion (nodding, shaking and rolling) of vehicle body and coupled vibration and motion thereof instead of merely a single motion mode. Therefore, it is of great theoretical and practical significance to develop a system suitable for the complex dynamic behavior control of high-speed trains.

Currently, the vibration and other unfavorable dynamic behaviors of high-speed trains are commonly controlled by using a suspension system. However, the existing suspension systems can work only in the vertical and lateral directions, and their output directions are also limited to the vertical and lateral directions, so that the suspension system cannot fully control the dynamic behavior of the high-speed trains, failing to sufficiently suppress the unfavorable dynamic responses.

During the actual operation process, the dynamic responses of trains will bring rotational motions, such as shaking, rolling and nodding. Moreover, these rotational motions cannot be effectively controlled by the linear force provided by the existing suspension systems. Therefore, the control effect of the existing suspension system on the trains is still limited, and the unfavorable dynamic responses of the trains cannot be fully suppressed.

In view of the increased speed of high-speed trains and requirements for riding comfort, the problems raised by the dynamic behaviors of trains, especially those involving rotational motion, generated from the complex effects during high-speed operation, will become more prominent. Therefore, it is of great theoretical and practical significance to develop a control system, which can directly output the control torque, to overcome the defects in the existing suspension technology, alleviating the unstable motion behaviors of the vehicle body when exposed to dynamic disturbance and the damages to the vehicle body and improving the dynamic stability, riding comfort and service life of the train.

SUMMARY

In view of the deficiencies of the suspension system in the prior art, an object of the present disclosure is to provide an active control system for rolling behaviors of high-speed trains, which can effectively control the rotational motion of the train, such as yawing, rolling and nodding.

The present disclosure provides an active control system for a rolling behavior of a high-speed train, comprising:

a sensor arranged on the train;

a controller; and an output device;

wherein the output device is arranged on a joint between two adjacent carriages of the train; the output device comprises a power unit, an output unit and a casing; and the power unit and the output unit are provided inside the casing;

the casing comprises a bottom plate, an annular side plate and a cover plate; the casing is further provided with a through hole which penetrates through the bottom plate and the cover plate; and the bottom plate and the cover plate are arranged the two adjacent carriages, respectively;

the power unit comprises a motor and a speed-increasing gear set; the speed-increasing gear set comprises a main speed-increasing gear and a secondary speed-increasing gear; the motor is fixed on the bottom plate; the main speed-increasing gear is arranged on the motor and the secondary speed-increasing gear is fixed on the bottom plate; the main speed-increasing gear engages with the secondary speed-increasing gear; and the sensor and the motor are electrically connected to the controller, respectively;

the output unit comprises a rotation inertia ring, a torque transmission ring and a connecting ring which are all hollow circular rings; the rotation inertia ring, the torque transmission ring and the connecting ring are coaxial with the through hole, respectively; the connecting ring is fixed on the bottom plate; the torque transmission ring is connected between the rotation inertia ring and the connecting ring; an outer circumference of the rotation inertia ring is provided with teeth; and the rotation inertia ring engages with the secondary speed-increasing gear through the teeth.

In some embodiments, the power unit comprises four power units; and the four power units are arranged evenly around the output unit.

In some embodiments, the connecting ring is provided with an annular slot; and the torque transmission ring is inserted into the annular slot and fixedly connected to the connecting ring.

In some embodiments, the rotation inertia ring and the torque transmission ring are integrally formed.

In some embodiments, a diameter of the secondary speed-increasing gear is smaller than that of the main speed-increasing gear.

In some embodiments, the torque transmission ring is made of rubber.

In some embodiments, a center of the output device is located on a central axis of the carriages.

In some embodiments, the sensor is arranged on a top of the carriage; and the controller is fixed on a bottom of the motor.

Compared to the prior art, the present invention has the following beneficial effects.

(1) The active control system applies active control torque to the shaking, rolling and nodding motions of the train body to control the train, which overcomes the defects in the existing suspension systems for vibration control of high-speed trains.

(2) The active control system reduces the unstable motion behavior of the vehicle body caused by dynamic disturbances, improving the dynamic stability of the vehicle body, the riding comfort and service life, and reducing the destruction and damage to the vehicle body.

(3) The active control by the system can maximize the performance of the control system, ensuring the control efficiency.

Figure 1:
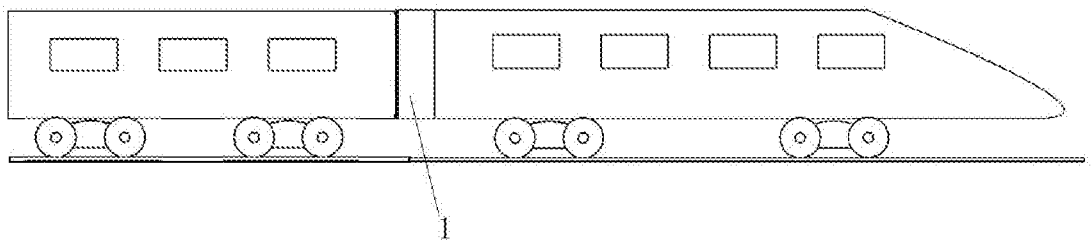
FIG. 1 is a schematic diagram showing the arrangement of an active control system according to an embodiment of the present disclosure.

In the drawings: 1. output device; 2. bottom plate; 3. annular side plate; 4. cover plate; 5. through hole; 6. motor; 7. main speed-increasing gear; 8. secondary speed-increasing gear; 9. rotation inertia ring; 10. torque transmission ring; 11. connecting ring; 12. annular slot; 13. speed-increasing gear set; 14. power unit; 15. output unit; and 16. casing.

DETAILED DESCRIPTION OF EMBODIMENTS

The invention will be described in detail below with reference to the accompanying drawings.

Provided herein is an active control system for a rolling behavior of a high-speed train, which includes a sensor, a controller and an output device 1. As shown in FIG. 1, the output device 1 is arranged at a joint between two adjacent carriages of the train, and a center of the output device 1 is located on a central axis of the carriages.

The output device 1 includes a power unit 14, an output unit 15 and a casing 16.

Figure 2:
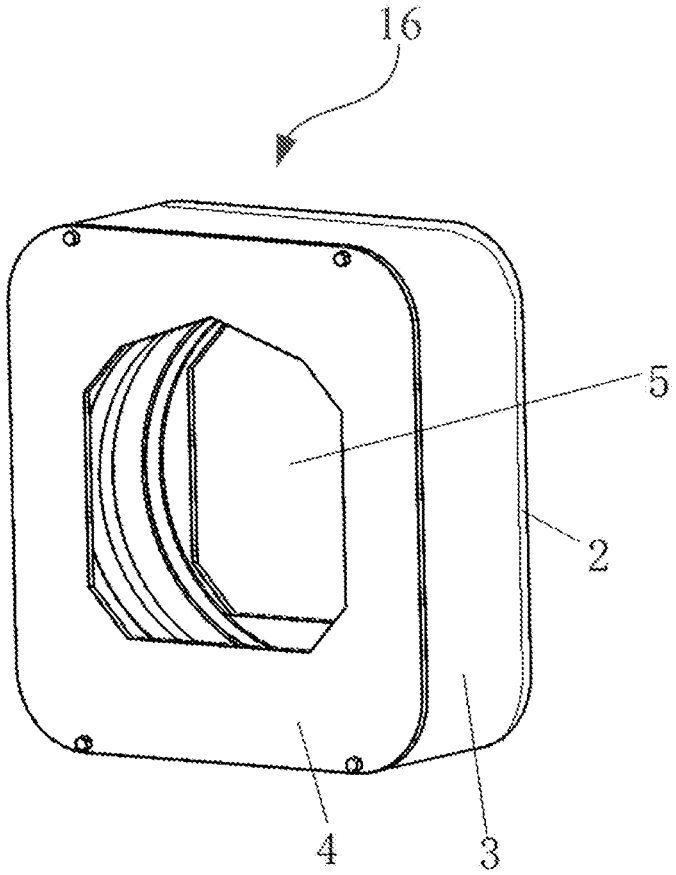
FIG. 2 is a schematic diagram of a structure of a casing.
Figure 3:
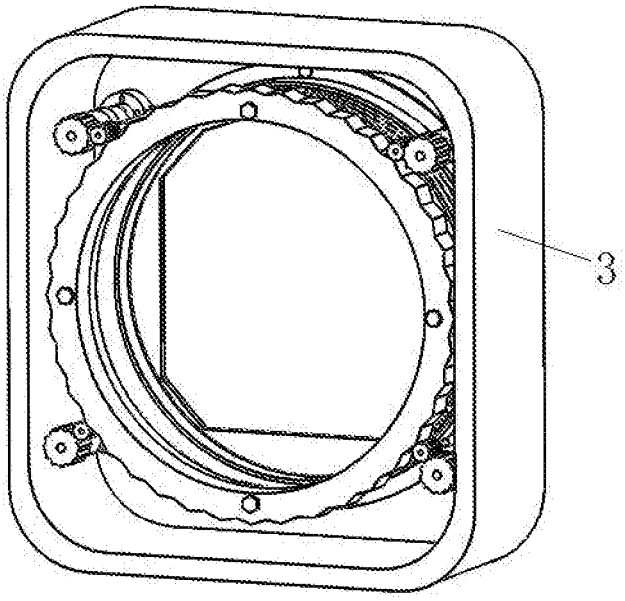
FIG. 3 schematically depicts an internal structure of an output device of the active control system according to an embodiment of the present invention.

As shown in FIGS. 2-3, the casing 16 includes a bottom plate 2, an annular side plate 3 and a cover plate 4. The bottom plate 2 is fixedly connected to one side of the annular side plate 3, and the cover plate 4 is fixedly connected to the other side of the annular side plate 3. The bottom plate 2 and the cover plate 4 are fixedly connected to the two adjacent carriages, respectively. The casing 16 is further provided with a through hole 5 which penetrates through the bottom plate 2 and the cover plate 4. The power unit 14 and the output unit 15 are both arranged inside the casing 16.

Figure 4:
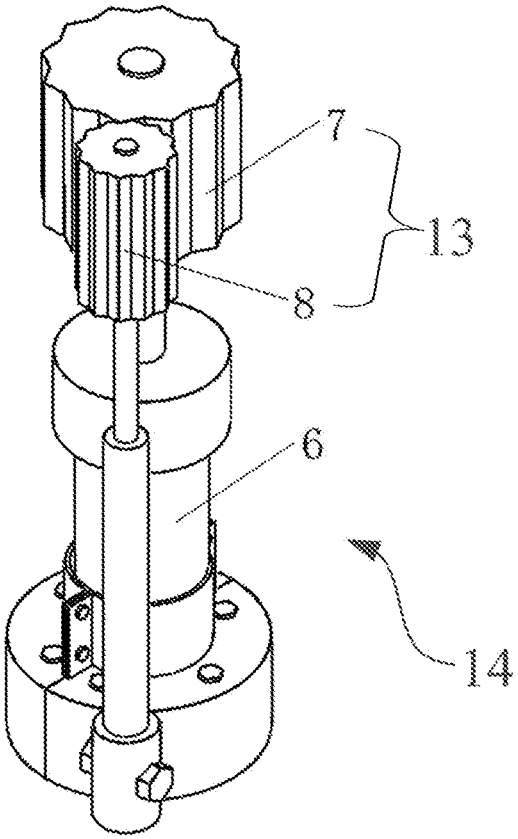
FIG. 4 is a schematic diagram showing a structure of a power unit according to an embodiment of the present disclosure.

As shown in FIG. 4, the power unit 14 includes a motor 6 and a speed-increasing gear set 13. The speed-increasing gear set 13 includes a main speed-increasing gear 7 and a secondary speed-increasing gear 8. The motor 6 is fixed on the bottom plate 2. The main speed-increasing gear 7 is arranged on the motor 6, and the secondary speed-increasing gear 8 is fixed on the bottom plate 2. The main speed-increasing gear 7 and the secondary speed-increasing gear 8 engage with each other. A diameter of the secondary speed-increasing gear 8 is smaller than that of the main speed-increasing gear 7.

Figure 5:
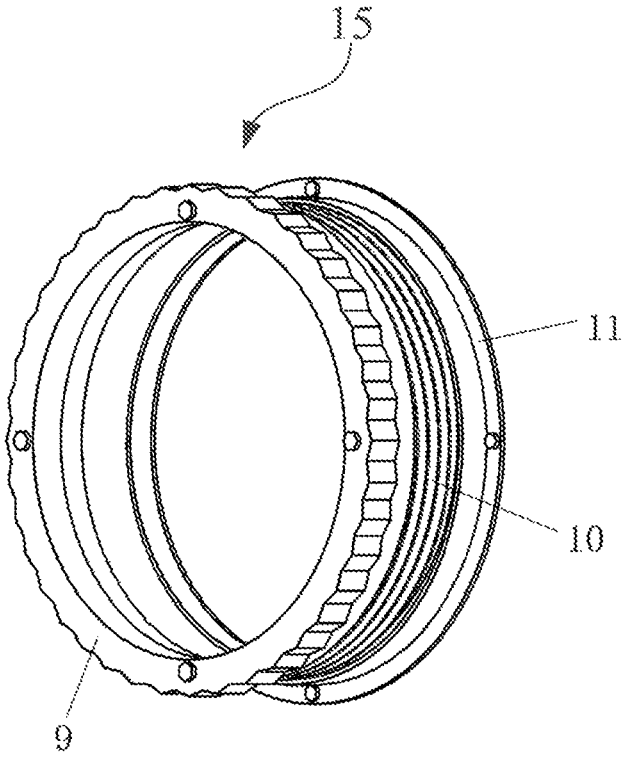
FIG. 5 is a schematic diagram showing a structure of an output unit according to an embodiment of the present disclosure.
Figure 6:
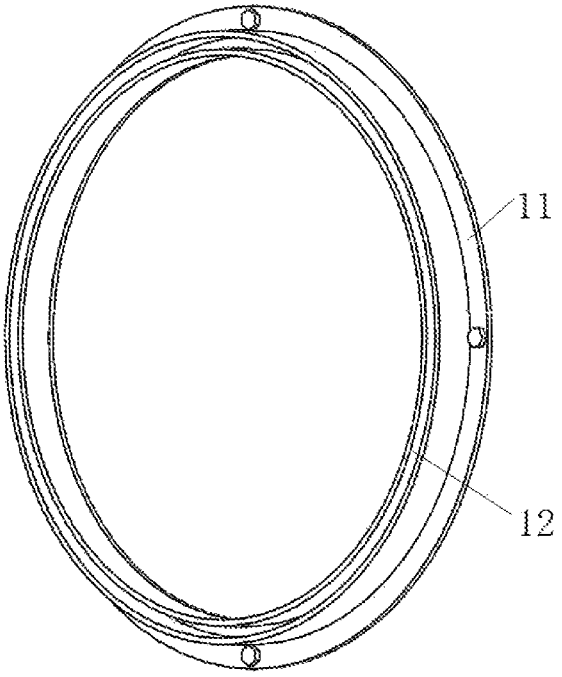
FIG. 6 is a schematic diagram illustrating a structure of a connecting ring according to an embodiment of the present disclosure.
Figure 7:
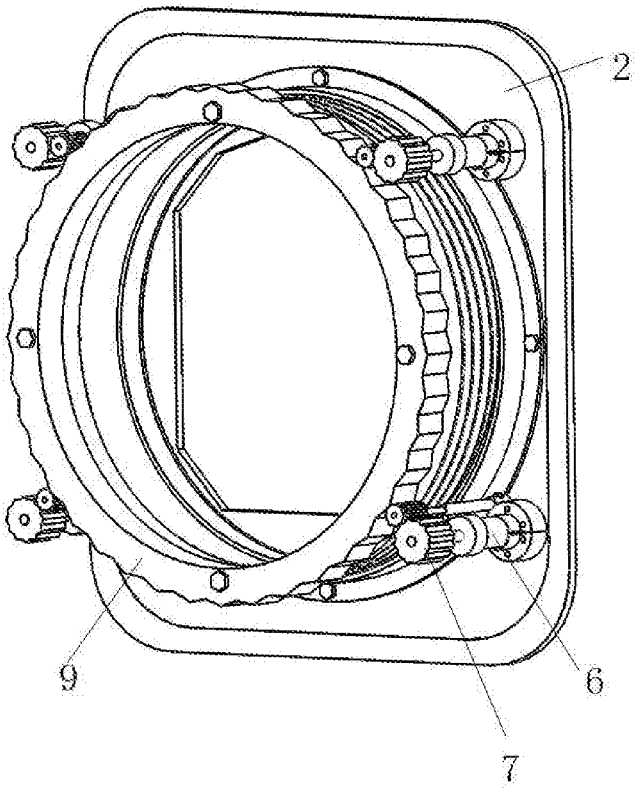
FIG. 7 schematically illustrates the assembly of the power unit and the output unit according to an embodiment of the present disclosure.

As shown in FIGS. 5-7, the output unit 15 includes a rotation inertia ring 9, a torque transmission ring 10 and a connecting ring 11 which are all a hollow circular ring. The rotation inertia ring 9 and the torque transmission ring 10 are coaxial with the connecting ring 11. The connecting ring 11 is fixed on the bottom plate 2. Specifically, the connecting ring 11 is bolted to the bottom plate 2. The torque transmission ring 10 is connected between the rotation inertia ring 9 and the connecting ring 11, and the connecting ring 11 is provided with an annular slot 12. The rotation inertia ring 9 and the torque transmission ring 10 are integrally formed, and the torque transmission ring 10 is inserted into the annular slot 12 and fixedly connected to the connecting ring 11. The torque transmission ring 10 is made of rubber, preferably a rubber material of relatively large hardness, so that the torque transmission ring 10 can transmit torque and has a certain damping. An outer circumference of the rotation inertia ring 9 is provided with teeth, and the rotation inertia ring 9 engages with the secondary speed-increasing gear 8 through the teeth. In an embodiment, there are four power units 14, which are arranged evenly around the output unit 15.

The rotation inertia ring 9, the torque transmission ring 10 and the connecting ring 11 are coaxial with the through hole 5. The bottom plate 2 and the cover plate 4 are fixedly connected to the carriages at two sides of the joint, respectively. A passage is formed at the middle of the entire control system, which is communicated with the carriages to allow passengers to pass through.

The sensor is arranged on a top of the carriage, and the controller is fixed on a bottom of the motor 6. The sensor and the motor 6 are electrically connected to the controller, respectively.

The function mechanism of the invention is described as follows.

The sensor monitors the real-time response of the train to steering angle and converts it into an electrical signal and transmits the electrical signal to the controller. The controller outputs a control electrical signal through a series of solutions and transmits it to the motor 6. The motor 6 drives the speed-increasing gear set 13 to rotate, so as to drive the rotation inertia ring 9 to accelerate or decelerate the slewing to generate a control torque. The torque is transmitted to the bottom plate 2 through the torque transmission ring 10 and the connecting ring 11, and finally applied to the vehicle body. The present invention outputs the control force by changing the rotation speed and direction of the motor 6, so as to achieve the controlling of the response of the train to steering angle.

The present invention is designed based on the basic concept of mechanics, that is, force is not equivalent to the couple. In some cases, the motion characteristics of the controlled subject determine that the rotational motion must be controlled by torque. Therefore, the traditional control systems that act based on force output or linear motion will fail to effectively control the rotational motion. In view of this, the present invention provides a control method, in which the control torque is directly applied to the vehicle body, to overcome the defects in the existing suspension systems for the vibration control of high-speed trains.

It should be noted that the described above are merely preferred embodiments of the invention, which are not intended to limit the invention. Any modification, equivalent replacement and improvement made by those skilled in the art without departing from the spirit of the invention should fall within the scope of the invention defined by the appended claims.

What is claimed is:

1. An active control system for a rolling behavior of a high-speed train, comprising:

a sensor arranged on the train;

a controller; and an output device;

wherein the output device is arranged on a joint between two adjacent carriages of the train;

the output device comprises a power unit, an output unit and a casing; and the power unit and the output unit are provided inside the casing; the casing comprises a bottom plate, an annular side plate and a cover plate; the casing is further provided with a through hole which penetrates through the bottom plate and the cover plate; and the bottom plate and the cover plate are arranged on the two adjacent carriages, respectively;

the power unit comprises a motor and a speed-increasing gear set; the speed-increasing gear set comprises a main speed-increasing gear and a secondary speed-increasing gear; the motor is fixed on the bottom plate; the main speed-increasing gear is arranged on the motor and the secondary speed-increasing gear is fixed on the bottom plate; the main speed-increasing gear engages with the secondary speed-increasing gear; and the sensor and the motor are electrically connected to the controller, respectively; and the output unit comprises a rotation inertia ring, a torque transmission ring and a connecting ring which are all hollow circular rings; and the rotation inertia ring, the torque transmission ring and the connecting ring are coaxial with the through hole; the connecting ring is fixed on the bottom plate; the torque transmission ring is connected between the rotation inertia ring and the connecting ring; an outer circumference of the rotation inertia ring is provided with teeth; and the rotation inertia ring engages with the secondary speed-increasing gear through the teeth.

2. The active control system of claim 1, wherein the power unit comprises four power units; and the four power units are arranged evenly around the output unit.

3. The active control system of claim 1, wherein the connecting ring is provided with an annular slot; and the torque transmission ring is inserted into the annular slot and fixedly connected to the connecting ring.

4. The active control system of claim 1, wherein the rotation inertia ring and the torque transmission ring are integrally formed.

5. The active control system of claim 1, wherein a diameter of the secondary speed-increasing gear is smaller than that of the main speed-increasing gear.

6. The active control system of claim 1, wherein the torque transmission ring is made of rubber.

7. The active control system of claim 1, wherein a center of the output device is located on a central axis of the carriage.

8. The active control system of claim 1, wherein the sensor is arranged on a top of the carriage; and the controller is fixed on a bottom of the motor.

* * * * *